United States Patent [19]

Aoyama

[11] 4,158,037

[45] Jun. 12, 1979

[54] EXHAUST GAS PURIFIER FOR INTERNAL COMBUSTION ENGINE

[75] Inventor: Toshiho Aoyama, Nagoya, Japan

[73] Assignee: Chuo Hatsujo Kabushiki Kaisha, Nagoya, Japan

[21] Appl. No.: 905,917

[22] Filed: May 15, 1978

[30] Foreign Application Priority Data

May 16, 1977 [JP] Japan ..... 52/55491

[51] Int. Cl.[2] ..... B01J 35/04; F01N 3/15; B01J 9/02

[52] U.S. Cl. ..... 422/179; 138/108; 138/112; 422/180

[58] Field of Search ..... 422/179, 180, 221, 222, 422/177; 138/108, 112

[56] References Cited

U.S. PATENT DOCUMENTS

| | | | |
|---|---|---|---|
| 3,597,165 | 8/1971 | Keith et al. | 422/180 |
| 3,798,006 | 3/1974 | Bulluff | 422/179 |
| 3,817,714 | 6/1974 | Wiley | 422/179 |
| 3,854,888 | 12/1974 | Frietzshe et al. | 422/180 X |
| 3,912,459 | 10/1975 | Kearsley | 422/179 |
| 3,992,157 | 11/1976 | Stute | 422/179 |
| 4,004,888 | 1/1977 | Musall et al. | 422/179 |
| 4,039,291 | 8/1977 | Hergovalch et al. | 422/179 |

FOREIGN PATENT DOCUMENTS

| | | | |
|---|---|---|---|
| 2233886 | 7/1972 | Fed. Rep. of Germany | 422/179 |
| 2220921 | 11/1973 | Fed. Rep. of Germany | 422/179 |
| 2261663 | 6/1974 | Fed. Rep. of Germany | 422/179 |
| 2303789 | 8/1974 | Fed. Rep. of Germany | 422/179 |
| 50-60466 | 5/1975 | Japan | 422/179 |

*Primary Examiner*—Barry S. Richman
*Attorney, Agent, or Firm*—Frank J. Jordan

[57] ABSTRACT

A catalytic converter of cassette type having a monolithic honeycomb structure of catalyst-coated ceramic body which is resiliently supported within an outer cylindrical metal shell. The shell includes first and second circumferential portions of an equal diameter which are at opposite axial ends thereof, and a third circumferential portion located therebetween and which has a greater outer diameter than the first and second portions. Thus bevelled areas are defined between the first and the third and between the second and the third circumferential portions. The converter is rigidly mounted in a gas passage defined by a pair of tubular members which are connected in tandem with an internal combustion engine. One of the tubular members has an inwardly extending annular rib at a given distance from the end thereof. The converter can be firmly supported at a predetermined position within said one tubular member by the engagement of one bevelled area on its outer shell with the annular rib and the abutment of the shell against the end of the other tubular member under pressure.

6 Claims, 5 Drawing Figures

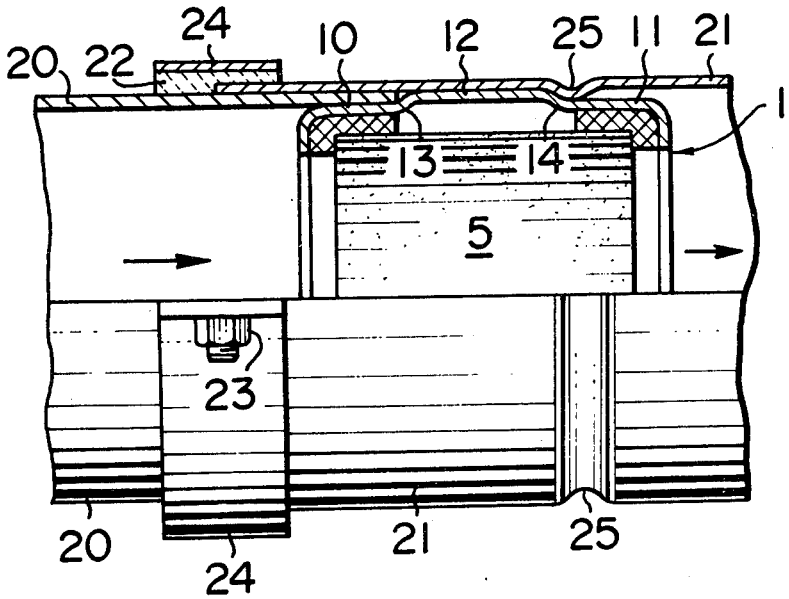

EXHAUST GAS PURIFIER FOR INTERNAL COMBUSTION ENGINE

FIELD OF THE INVENTION

The invention relates to an exhaust gas purifier for internal combustion engines, and more particularly to a catalytic converter of cassette type which can be easily mounted in a gas passage.

An exhaust gas purifier for an internal combustion engine which includes a monolithic honeycomb structure of catalyst-coated ceramic body is disclosed in U.S. Pat. No. 3,441,381. The concerned problem in the art has been to mount such purifier on an automotive vehicle while avoiding undue stresses on the sensitive ceramic body which is mounted within a metal casing. Since both the ceramic body and the casing are subjected to high thermal loadings and rapid changes in temperature, the thermal deformation and degradation of the materials must be taken into consideration. To cater for this problem, there has been proposed the use of a net-like cushion formed by thin wires of stainless steel or special steel such as Inconel, or a corrugated woven metal meshwork or pressed work of a complicate steel wire assembly, which is disposed between the ceramic body and the casing to accommodate any radial and axial pressure exerted upon the ceramic body. Various configurations of such metal meshwork cushions and their layout between the ceramic body and the casing are disclosed, for example, in Japanese Laid-Open Patent Application No. 50-60466, West Germany Laid-Open Patent Applications No. 2,243,251, No. 2,303,789, No. 2,233,886 and No. 2,261,663.

A conventional catalytic purifier is installed on an automotive vehicle by mounting a metal casing which contains a ceramic body on the end of an exhaust pipe. Because the gas leaving the purifier is still at higher temperatures, it is necessary to provide a cooling pipe at the outlet thereof, which resulted in a troublesome mounting operation. While the difficulty can be overcome by providing an excess length of tubular portion which corresponds to the length of the cooling pipe in integral manner with the casing, in more general situations where the purifier is manufactured at a location which is separate from the assembly of the vehicles, a casing of an increased size is undesirable from the standpoint of shipment. A casing of this kind is also economically undesirable when the purifier must be replaced due to the degradation of the catalyst capability and abrasion of catalyst carriers. Therefore, there has been a need for a catalytic converter of cassette type which can be easily mounted in a gas passage, but such need has not been met successfully.

DESCRIPTION OF THE PRIOR ART

West Germany Pat. No. 2,220,921 discloses a catalytic converter of cassette type in which a catalyst carrier is mounted within an outer metal shell with a resilient support interposed therebetween. The converter is disposed in a space defined by abutting funnel-shaped ends of a pair of tubular members with a clearance, and a plurality of resilient annular supports are disposed in the clearance. This requires an accurate positioning of individual resilient supports, which must be fully compressed in order to prevent later oscillations of the converter. Obviously, this presents an operational difficulty. In addition, with this arrangement, unpurified exhaust gas may leak through the resilient supports.

SUMMARY OF THE INVENTION

It is an object of the invention to provide an exhaust gas purifier for internal combustion engines which can be easily mounted in a gas passage.

It is a specific object of the invention to provide an exhaust gas purifier for internal combustion engines which includes a catalytic converter of cassette type.

In accordance with the invention, there is provided an exhaust gas purifier for internal combustion engines which comprises a pair of tubular members which define a passage for exhaust gas, means for connecting the tubular members in tandem and in coaxial manner, and a catalytic converter of cassette type which is mounted within the gas passage, the converter being inserted into one of the tubular members when the pair of members are connected together, and when said one member is connected with the other member, the converter is firmly secured within the tubular members. The pair of tubular members may comprise an exhaust pipe and an exhaust gas cooling pipe associated with an engine.

The catalytic converter comprises an outer cylindrical metal shell having inwardly directed radial flanges at its opposite ends which define a gas inlet and a gas outlet, respectively, and also having a first circumferential portion located adjacent to the gas inlet and a second circumferential portion located adjacent to the gas outlet which are substantially of an equal outer diameter and a third circumferential portion located between the first and second portions and having a greater outer diameter than the latter, thereby providing a first bevelled area between the first and the third circumferential portions and a second bevelled area between the second and third circumferential portions a catalyst carrier in the form of a monolithic porous ceramic body coated with catalyst, and resilient support means for mounting the carrier within the outer shell. One of the tubular members which define the gas passage has an inner diameter greater than the diameter of the third circumferential portion of the shell, and is provided with an annular rib on its inner surface which is located at a given distance from the end thereof. The annular rib has a diameter which is greater than that of the first and second circumferential portions and which is less than the diameter of the third circumferential portion. Converter is held sandwiched between the tubular members by the engagement of the first or second bevelled area of the shell with the annular rib of said one tubular member and the abutment of the shell against the end of the other tubular member.

DESCRIPTION OF PREFERRED EMBODIMENTS

Figure 1:
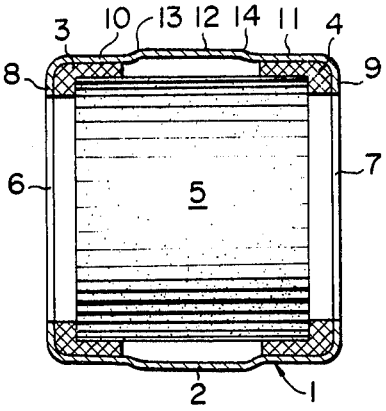
FIG. 1 is a cross section of a catalytic converter of cassette type according to the invention.

Referring to FIG. 1, there is shown a catalytic converter of cassette type which is generally shown by reference numeral 1. The converter includes an outer cylindrical metal shell 2, and a catalyst carrier 5 which is located within the shell by a pair of L-shaped annular resilient supports 3, 4. At its opposite ends, the shell is provided with radially inwardly extending flanges 8, 9, which define a gas inlet 6 and a gas outlet 7, respectively. The shell includes a first circumferential portion 10 located adjacent to the inlet 6 and a second circumferential portion 11 located adjacent to the outlet 7 which are of an equal diameter. The shell also includes a third circumferential portion 12 located between the first and second portions and having a diameter greater than the diameter of the latter. As a consequence, a first bevelled area 13 is defined between the first and the third circumferential portions 10, 12 and a second bevelled area 14 is defined between the second and the third circumferential portions 11, 12. The resilient supports 3, 4 may comprise a metal meshwork cushion of a known form, and are fitted into the corners adjacent to the inlets 6 and outlets 7, respectively. The catalyst carrier 5 is well known and therefore will not be described in detail. However, briefly, it comprises monolithic honeycomb structure of ceramic body having a plurality of open-ended cells extending across its opposite ends, with the cell surface being coated with catalyst such as platinum, for example. The catalyst carrier 5 is resiliently supported within the shell 2 both axially and radially by means of the resilient supports 3, 4. The pair of L-shaped supports may be replaced by separate sets of radial supports and axial supports.

Figure 2:
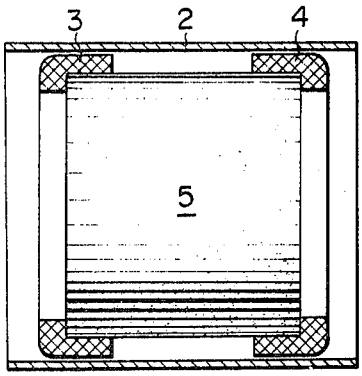
FIG. 2 illustrates the manufacture of the catalytic converter shown in FIG. 1.

FIG. 2 illustrates the manufacture of the catalytic converter shown in FIG. 1. The catalyst carrier 5 is mounted within a metal pipe which provides the shell 2 by means of the annular supports 3, 4, and then the metal pipe is constricted or reduced as by reducing roll or reducing press. During the reduction, the resilient supports 3, 4 are also compressed to a higher density than is normal solid state density. A preferred density of such resilient supports is detailed in Japanese Laid-Open Patent Application 50-60406.

Figure 3:
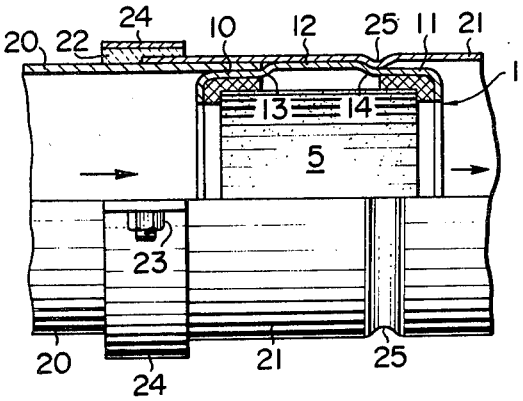
FIG. 3, 4 and 5 are side elevations, partly in section, of several embodiments of the exhaust gas purifier for internal combustion engines of the invention.

FIG. 3 shows an exhaust gas purifier for internal combustion engines which is constructed in accordance with the invention. In this Figure, corresponding parts are designated by like numerals as in FIG. 1. An exhaust gas passage of an internal combustion engine is defined by a first and a second tubular members 20, 21 which are connected in tandem and in coaxial relationship. In this example, the first member 20 is connected with the engine while the second member 21 communicates with the atmosphere. The second member 21 has an inner diameter which is slightly greater than the outer diameter of the first member 20 so that its end can be fitted over the adjacent end of the first member 20. The both members are firmly connected together by a fastener band 24 which surrounds overlapping ends of the both members with a heat-resistant gasket 22 interposed therebetween and which is clamped by a screw 23. The member 21 is internally provided with an annular rib 25 at a given distance from the end thereof.

In the example shown, the first tubular member 20 has an inner diameter which is slightly greater than the outer diameter of the first circumferential portion 10 of the shell 2, and the second tubular member 21 has an inner diameter which is slightly greater than the outer diameter of the third circumferential portion 12. The annular rib 25 has an inner diameter which is slightly greater than the outer diameter of the second circumferential portion 11 of the shell. The converter 1 is firmly secured in a gas passage defined by the members 20, 21 by the engagement of the second bevelled area 14 against the annular rib 25, and the first bevelled area 13 which is forced against the end of the first tubular member 20. Since there is no substantial clearance between the tubular members and the shell 2, the gas which is fed through the tubular member 20 is entirely passed through the converter 1 to be discharged into the outer tubular member 21. The direction of such gas flow is indicated by an arrow in FIG. 3.

It will be seen that the mounting of the converter 1 can be easily achieved by inserting it deep into the second tubular member 21, fitting the latter over the end of the first tubular member 20, and clamping the end of the second tubular member 21 with the fastener band 24, thus requiring no skill for its operation.

Figure 4:
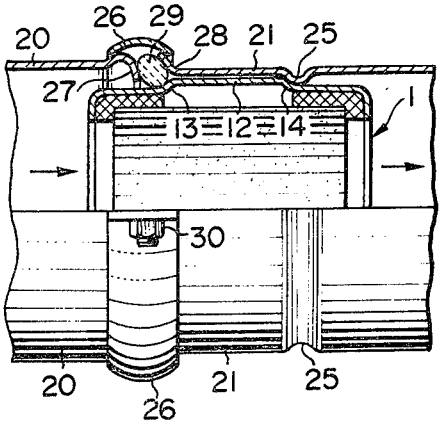

FIG. 4 shows another embodiment of the exhaust gas purifier in which the both tubular members 20, 21 are connected together with a fastener band 26 which is arcuate in cross section. The end of the first tubular member 20 is formed with an outwardly projecting annular rib 27 while the opposing end of the second tubular member 21 is formed with an outwardly open annular lip 28. A heat-resistant gasket 29 is interposed between the parts 27, 28 for engagement with the first bevelled area 13 of the shell 2. The fastener band 26 is engaged with both rib 27 and lip 28, and when it is clamped by the clamping screw 30, the both parts 27, 28 are moved toward each other against the resilience of the gasket 29, thus providing a rigid connection therebetween. As a result, it can be said that the first bevelled area 13 of the shell 2 is forced against the rib 27 at the end of the first tubular member 20 through the gasket 29. While a clearance 31 is shown between the second tubular member 21 and the third circumferential portion of the shell 2 in this example, no leakage of gas can occur through such clearance since a seal is effectively formed by the engagement between the annular rib 25 and the second bevelled area 14 of the shell 2.

Figure 5:
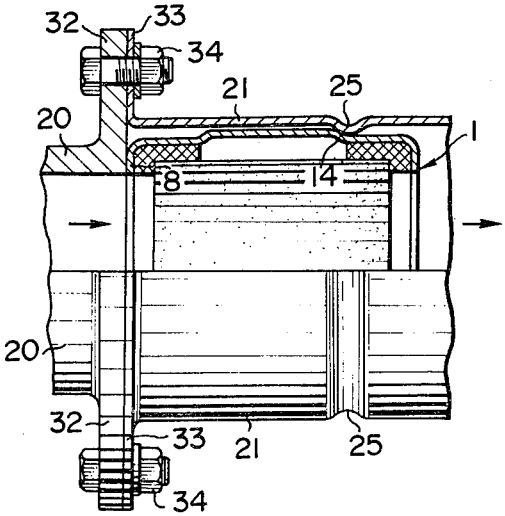

FIG. 5 shows a further embodiment in which the first and the second tubular members are provided with radial flanges 32, 33 at their adjacent ends which extend outwardly and which are rigidly connected together by a plurality of screws 34. The first member 20 has an inner diameter which is less than that of the second member 21 and when they are connected together, the second bevelled area 14 of the shell 2 engages the annular rib 25 on the second tubular member 21, whereby the flange 8 of the shell 2 is forced against the flange 32 of the first tubular member 20.

While the invention has been shown and described specifically with reference to specific embodiments thereof, it should be understood that they are exemplary only and not limitative of the invention. A variety of changes and modifications will occur to those skilled in the art without departing from the spirit of the invention. By way of example, the first and second tubular members may be interchanged with respect to the direction of gas flow.

What is claimed is:

1. A catalytic converter of cassette type which is adapted to be mounted in an exhaust gas passage of an internal combustion engine comprising an outer cylindrical metal shell having inwardly directed radial flanges at its opposite ends which define a gas inlet and gas outlet and also including a first circumferential portion located adjacent to the gas inlet and a second circumferential portion located adjacent to the gas outlet which are of an equal outer diameter and a third circumferential portion interposed between the first and second portions and having a greater outer diameter than the latter, thus defining a first bevelled area between the first and the third circumferential portion and a second bevelled area between the second and the third circumferential portion, a catalyst carrier in the form of a monolithic, porous ceramic body coated with catalyst, and resilient support means for mounting the catalyst carrier within the shell.

2. An exhaust gas purifier for internal combustion engines comprising a pair of tubular members which define a passage for exhaust gas, means for connecting the tubular members in tandem and in coaxial manner, and a catalytic converter of cassette type which is adapted to be mounted within the gas passage, the catalytic converter including an outer cylindrical metal shell having inwardly directed radial flanges at its opposite ends which define a gas inlet and gas outlet and also including a first circumferential portion located adjacent to the gas inlet and a second circumferential portion located adjacent to the gas outlet which are of an equal outer diameter and a third circumferential portion interposed between the first and second portions and having a greater outer diameter than the latter, thus defining a first bevelled area between the first and the third circumferential portion and a second bevelled area between the second and the third circumferential portion, a catalyst carrier in the form of a monolithic, porous ceramic body coated with catalyst, and resilient support means for mounting the catalyst carrier within the shell, one of the tubular members having an outer diameter which is greater than the third circumferential portion of the shell and being internally provided with a stop at a given distance from the end thereof which is of an inner diameter which is greater than the outer diameter of the first and second circumferential portions and less than the outer diameter of the third circumferential portion of the shell, the converter being held between the tubular members by the engagement of a selected bevelled area of the shell with the stop of said one tubular member and the engagement of the shell against the end of the other tubular member.

3. An exhaust gas purifier according to claim 2 in which the other tubular member has an outer diameter which is less than the inner diameter of said one tubular member and has an inner diameter which is substantially greater than the outer diameter of the first and second circumferential portions of the shell, the end of the other tubular member being received within the end of said one tubular member and engaged with the other bevelled area of the shell.

4. An exhaust gas purifier according to claim 2 in which the other tubular member has an outer diameter which is less than the inner diameter of said one tubular member and has an inner diameter which is substantially greater than the outer diameter of the first and second circumferential portions of the shell, the end of the other tubular member being received within the end of said one tubular member and engaged with the other bevelled area of the shell and wherein the mounting means comprises an annular band which is disposed around the end of said one tubular member for clamping the both tubular members together.

5. An exhaust gas purifier according to claim 2 in which the end of said one tubular member is provided with an outwardly open annular lip, and the end of the other tubular member is provided with an outwardly projecting annular rib, the mounting means comprising a gasket disposed between the lip and the rib, and an annular band having an arcuate cross section and engaging the lip and the rib for clamping them together against the resilience of the gasket, the annular rib being engaged with the other bevelled area of the shell through the gasket.

6. An exhaust gas purifier according to claim 2 in which the pair of tubular members are provided with outwardly extending flanges at their adjacent ends, the mounting means comprising screws which connect the flanges together, said other tubular member having an inner diameter which is less than the inner diameter of said one tubular member, the flange of said other tubular member engaging with the flange on the shell of the converter.

* * * * *